US012344443B2

(12) United States Patent
Ziegenfelder et al.

(10) Patent No.: US 12,344,443 B2
(45) Date of Patent: Jul. 1, 2025

(54) CONTAINER CLOSURES

(71) Applicant: Sonoco Development, Inc., Hartsville, SC (US)

(72) Inventors: Kurt A. Ziegenfelder, Florence, SC (US); Steve Kubilius, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 17/942,924

(22) Filed: Sep. 12, 2022

(65) Prior Publication Data

US 2024/0083637 A1 Mar. 14, 2024

(51) Int. Cl.

| | |
|---|---|
| ***B65D 43/02*** | (2006.01) |
| ***B65D 21/02*** | (2006.01) |
| ***B65D 50/04*** | (2006.01) |

(52) U.S. Cl.

CPC ..... *B65D 43/0212* (2013.01); *B65D 21/0217* (2013.01); *B65D 50/045* (2013.01); *B65D 2543/00092* (2013.01); *B65D 2543/00527* (2013.01); *B65D 2543/00537* (2013.01); *B65D 2543/00638* (2013.01); *B65D 2543/00685* (2013.01); *B65D 2543/00759* (2013.01); *B65D 2543/00805* (2013.01); *B65D 2543/00842* (2013.01)

(58) Field of Classification Search

CPC ..... B65D 50/045; B65D 50/046; B65D 21/0219; B65D 21/0217; B65D 43/0212

See application file for complete search history.

(56) References Cited

U.S. PATENT DOCUMENTS

| | | | | |
|---|---|---|---|---|
| 3,430,796 A * | 3/1969 | Berg | B65D 50/045 215/206 |
| 3,653,581 A * | 4/1972 | Ptak | B65D 43/0208 229/199 |
| 4,723,677 A | 2/1988 | Nagel | |
| 5,449,077 A | 9/1995 | Seidler | |
| 6,880,729 B2 | 4/2005 | Stull et al. | |

(Continued)

FOREIGN PATENT DOCUMENTS

CA 2800172 A1 4/2006

OTHER PUBLICATIONS

International Search Report and Written Opinion for Application No. PCT/US2023/031815; Dated Jan. 3, 2024, 13 pages [only new art cited herein—US Publication 2004/0195241 was previously on Jun. 6, 2023).

*Primary Examiner* — Jeffrey R Allen
(74) *Attorney, Agent, or Firm* — Nelson Mullins Riley & Scarborough LLP

(57) ABSTRACT

A lid is disclosed herein. The lid comprises a base comprising a peripheral edge and a skirt extending downward from the peripheral edge. The skirt comprises a pair of release tabs diametrically opposite from one another. Each of the pair of release tabs are defined by a first cut and a second cut within the skirt which separates the release tab from the remainder of the skirt. Each of the release tabs is hingedly connected to the base. Each of the pair of the release tabs extend upwardly from the base, opposite the skirt. Each release tab further comprises a latching protrusion extending radially inward from an inner surface of the release tab towards a central axis of the lid.

22 Claims, 11 Drawing Sheets

(56) References Cited

U.S. PATENT DOCUMENTS

| | | | | |
|---|---|---|---|---|
| 8,590,719 | B2 | 11/2013 | Sprishen et al. | |
| 9,481,496 | B2 | 11/2016 | Cottle et al. | |
| 9,919,837 | B2 | 3/2018 | Batzel | |
| 2002/0084239 | A1 | 7/2002 | Dressel et al. | |
| 2004/0195241 | A1* | 10/2004 | Stull | B65D 41/0414 220/326 |
| 2015/0014269 | A1 | 1/2015 | Gillman | |
| 2015/0344202 | A1 | 12/2015 | Schneider et al. | |
| 2018/0312308 | A1 | 11/2018 | Hein et al. | |
| 2019/0177051 | A1 | 6/2019 | Sabherwal | |
| 2019/0276196 | A1 | 9/2019 | French et al. | |
| 2019/0276201 | A1* | 9/2019 | French | B65D 50/043 |
| 2021/0188499 | A1* | 6/2021 | Ekkert | B65D 50/061 |
| 2021/0276769 | A1 | 9/2021 | Dzurik et al. | |

* cited by examiner

CONTAINER CLOSURES

FIELD OF THE DISCLOSURE

The present disclosure relates to container closures, particularly to overcap closures that are removable from a container by a single hand.

BACKGROUND OF THE DISCLOSURE

Plastic lids may typically be used in container assemblies as a secondary (i.e. overcap) closure to provide a reclosability function, with a moisture barrier and/or oxygen barrier, to the products contained within a container. These container assemblies often comprise a rigid container body (e.g., cylindrical) manufactured with the top and bottom ends initially open. The composite container bodies may comprise rigid cans made from sheet material (e.g., spirally wound), such as cardboard and/or paperboard. Such container assemblies further include top and bottom end closures. While the bottom end closure (e.g., metal or paper end) is usually permanently affixed (e.g., seamed) to a bottom rim of the container body, the top end closure is often designed to be easily removed by the consumer (e.g., a plastic removable/replaceable overcap and/or a peelable membrane). Typically, the membrane is first sealed to the top rim of the container. The container interior is then filled with products (e.g., food products) through the open bottom end of the container body, and the metal or paper closure is affixed onto the bottom rim of the container body. In a conventional container, the plastic overcap may be applied over the membrane after sealing of the membrane and/or after affixing the bottom closure onto the container.

One disadvantage to the above-described conventional system is that the plastic removable/replaceable overcap may require both hands to remove the overcap (e.g., one to hold the container and the other to remove the overcap). Thus, even if the container is disposed on a surface, the container system must be picked up to remove the overcap and access the contents of the container. Therefore, there is a need for an overcap which is more easily removable from a container.

Through ingenuity and hard work, the inventors have developed an overcap which is easily removable with a single hand and provides a child proof closure around an open end of a container.

BRIEF SUMMARY OF THE DISCLOSURE

The present disclosure relates generally to an overcap having two integral, diametrically opposed release tabs configured to release the lid from the rim of a container body when pressed towards the axial center of the overcap. The release tabs define pressure points on opposing sides of the lid, such that when the release tabs are pressed towards one another, the pressure of the overcap against the container is relieved and the overcap may be easily removed from the body of the closure.

BRIEF DESCRIPTIONS OF THE SEVERAL VIEWS OF THE DRAWING(S)

A full and enabling disclosure directed to one of ordinary skill in the art, is set forth in the specification, which makes reference to the appended drawings, in which.

Figure 1A:
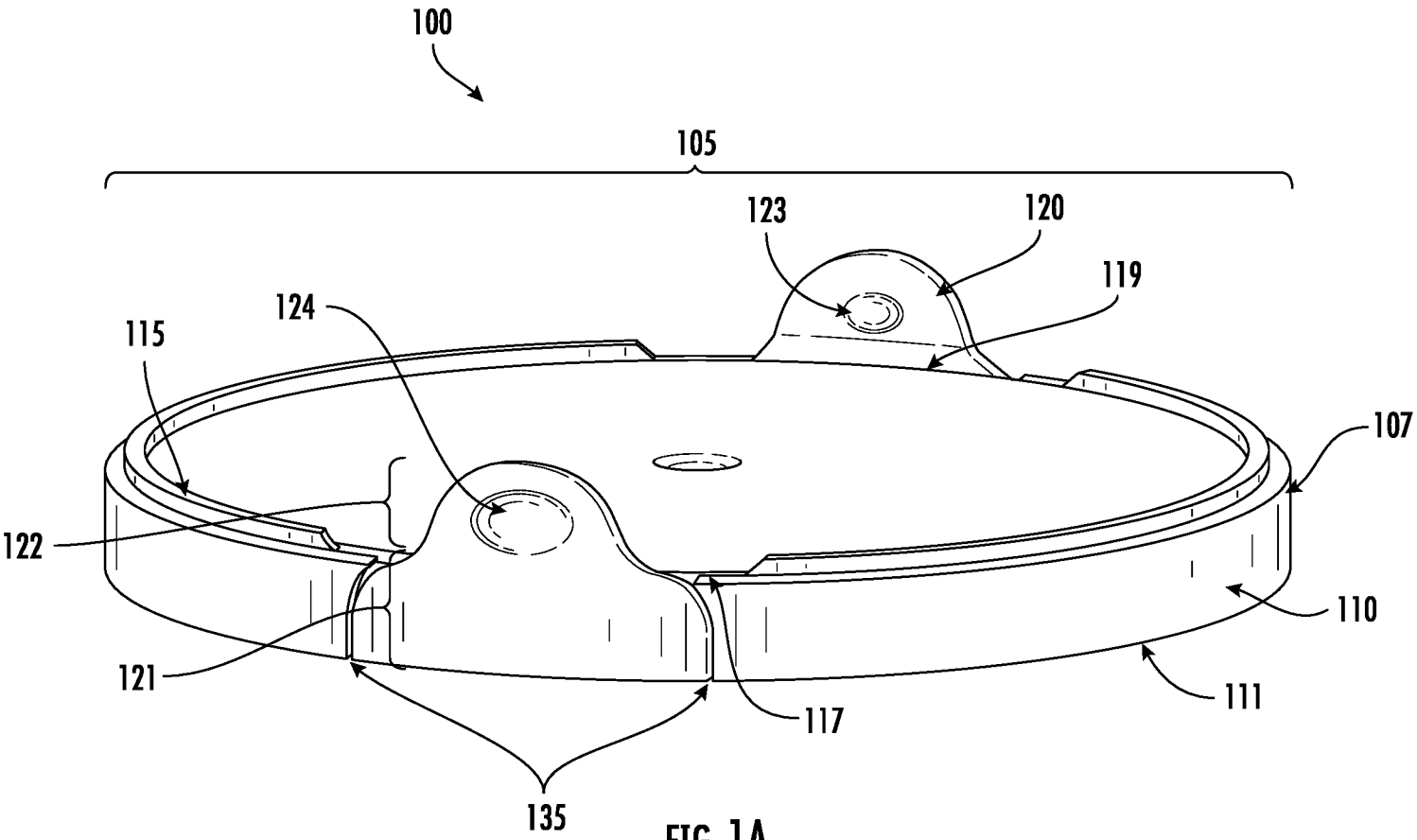
FIG. 1A illustrates a top perspective view of an example lid, in accordance with some embodiments of the present disclosure.

Repeated use of reference characters in the present specification and drawings is intended to represent the same or analogous features or elements of the present disclosure.

DETAILED DISCLOSURE

Reference will now be made in detail to embodiments of the present disclosure, one or more examples of which are illustrated in the accompanying drawings. Each example is provided by way of explanation of the present disclosure, not limitation of the present disclosure. In fact, it will be apparent to those skilled in the art that modifications and variations can be made in the present disclosure without departing from the scope or spirit thereof. For instance, features illustrated or described as part of one embodiment may be used on another embodiment to yield a still further embodiment. Thus, it is intended that the present disclosure covers such modifications and variations as come within the scope of the appended claims and their equivalents.

Figure 1B:
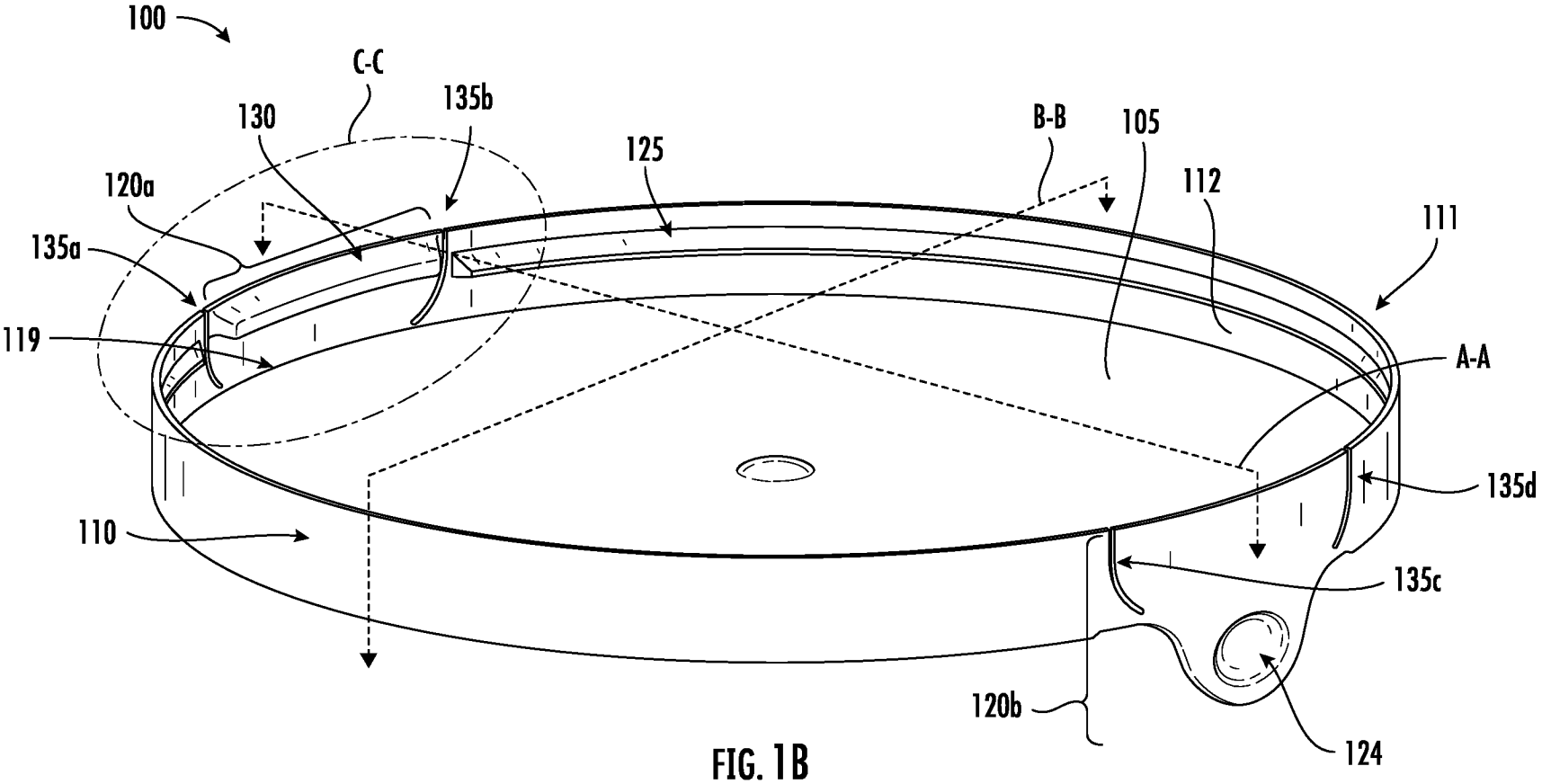
FIG. 1B illustrates a bottom perspective view of the example lid, in accordance with some embodiments of the present disclosure.

A lid 100 in accordance with a first embodiment of the invention is shown in FIGS. 1A-B. In some embodiments, the lid 100, comprises a base 105, and a skirt 110. The base 105 may comprise a peripheral edge 107 about the perimeter of the base 105. In some embodiments, the peripheral edge 107 may be a juncture between the base 105 and the skirt 110, forming a 90-degree angle (or an approximation thereof) therebetween.

In some embodiments, the lid 100 may comprise a first release tab 120*a* and a second release tab 120*b*, each disposed within, integral with, or extending upwardly from the skirt 110. Each release tab 120 may comprise a skirt portion 121 and an upper portion 122. The skirt portion 121 may be defined by a cut 135 on each side of the release tab 120 which separates the release tab from the remainder of the skirt 110 circumferentially. In some embodiments, the cut 135 may extend from a bottom edge 111 of the skirt 110 to the base 105, but not through the base 105. In some embodiments, the cut 135 may have a thickness, such that a portion of the skirt 110 is removed, thereby allowing easier movement of the release tabs 120. Although described as a "cut" it should be understood that any form of separation may be used. For example, in some embodiments, the cut 135 may be integrally formed when making the lid 100 (e.g., as a gap between the skirt 110 and the skirt portion 121 of the release tab 120). In some embodiments, the cut 135 may be formed as a slit between the skirt 110 and the skirt portion 112, while in other embodiments other forms of cuts may be used. In some embodiments, the cut 135 may be a separation between the release tab 120 and the skirt 110. For example, in an embodiment the lid may be 3-D printed, and rather than print a continuous skirt, the pattern may leave a space between the release tab 120 and the skirt 110.

In an embodiment, the interface between the skirt portion 121 of the release tab 120, the upper portion 122 of the release tab 120, and the base 105 may comprise a hinge 119 (see FIG. 1B). The hinge 119 may allow angular movement of the release tab 120, as will be described here. The hinge 119 may comprise a thin polymeric material that has sufficient flexibility to bend without fracturing. Any hinge formation known in the art may be utilized.

In some embodiments, a circumferential ridge 115 may extend from a top side of the base 105. The circumferential ridge 115 may be spaced radially inward from the circumferential edge 107. In some embodiments, the circumferential ridge 115 may be configured to receive and retain a container body (e.g., stacking) to prevent movement of one container atop another container, across the lid 100. In some embodiments, the circumferential ridge 115 may define a gap 117 adjacent each side of the release tabs 120 (see FIG. 3A). In some embodiments, the gap 117 may afford easier movement or hinging of the release tabs 120.

In some embodiments, the upper portion 122 of the release tabs 120 may extend upwardly above the base 105 of the lid 100. The upper portion 122 may define a divot 124 on an outer surface of the release tab 120, and a bulge 123 on an inner surface of the release tab 120. The divot 124 and the bulge 123 may be coextensive. Said differently, the divot 124 formed in the outer surface of the release tab 120 and the bulge 123 on the inner surface of the release tab 120 may be different surfaces of the same feature. In an embodiment, the divot 124 is sized and configured to receive a user's thumb or finger, providing easier gripability.

FIG. 1B illustrates a perspective view of the underside of the lid 100. In some embodiments, a first release tab 120*a* and a second release tab 120*b* may be diametrically opposite one another. The first release tab 120*a* may be defined by a first cut 135*a* and a second cut 135*b* formed within the skirt 110. Similarly, the second release tab 120*b* may be defined by a third cut and a fourth cut formed within in the skirt 110.

Figure 6A:
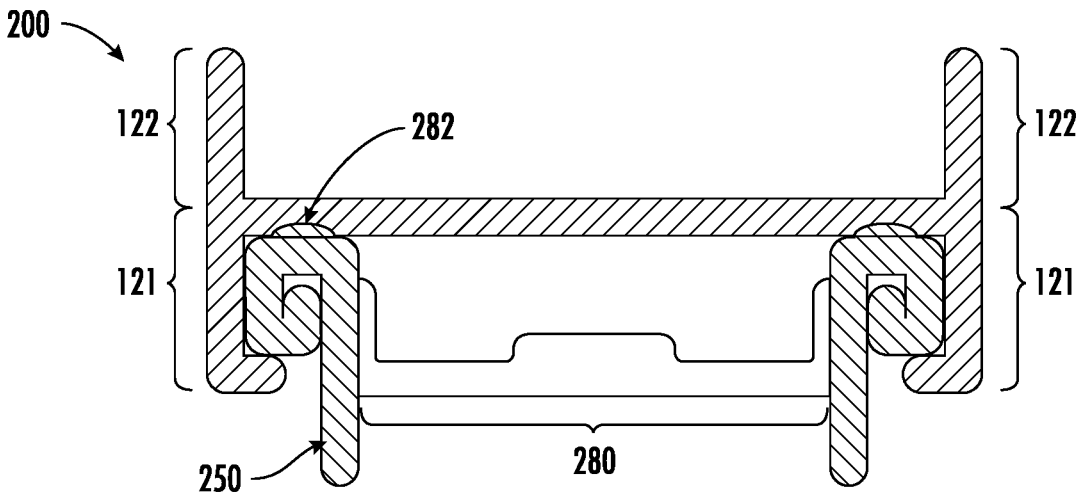
FIG. 6A illustrates a cross-sectional view of an example container system with the lid in a closed position.
Figure 6B:
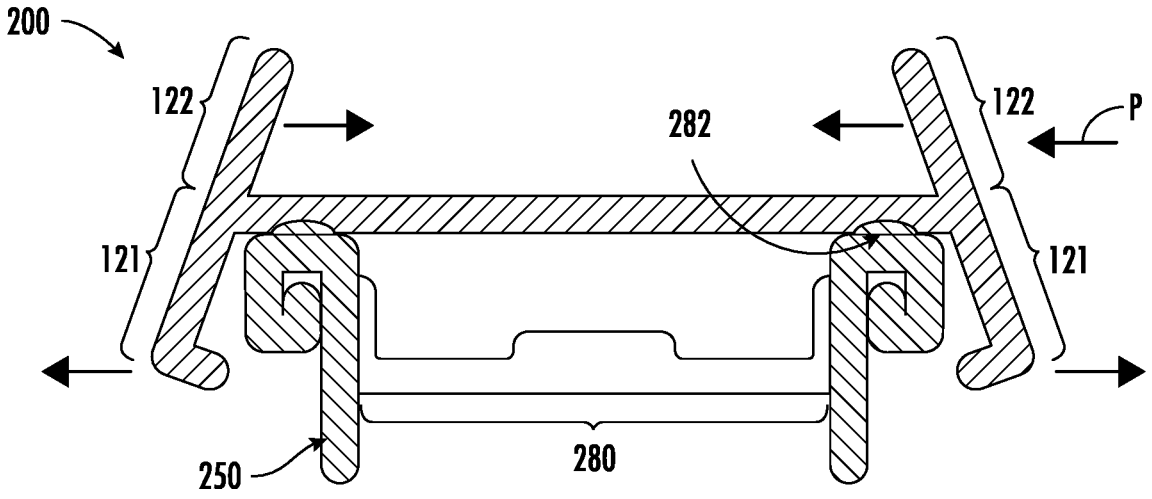
FIG. 6B illustrates a cross-sectional view of the example container system with the lid is a flexed position.

In some embodiments, with reference to FIGS. 6A-B, the first release tab 120*a* and the second release tab 120*b* are configured to be moved angularly (the upper portions 122 towards one another and the skirt portions 121 away from each other) by pressing the divots 124 towards one another. Thus, a portion of the release tabs 120 may pivot about the circumferential edge 107 of the base 105 and release the lid 100 from a container. In some embodiments, the upper portions 122 of the release tabs 120 are configured to be pressed together with a finger and a thumb (one on each release tab) by squeezing the release tabs 120 towards one another.

In some embodiments, each of the first release tab 120*a* and the second release tab 120*b* may define a latching protrusion 130 on an inner surface 112 of the skirt portion 121 of the release tabs 120. The remaining inner surface 112 of the skirt 110 may define a skirt protrusion 125. In some embodiments, a portion of the skirt protrusion 125 may extend between the first cut 135*a* and the third cut 135*c*, and a portion of the skirt protrusion 125 may extend between the second cut 135*b* and the fourth cut 135*d*. Said differently, the skirt protrusion 125 extends, at least partially, about the circumference of the inner surface 112 of the skirt 110 that does not include one of the first or second release tabs 120*a*, 120*b*. In some embodiments, the skirt protrusion 125 may comprise a plurality of skirt protrusions 125 disposed about the circumference of the inner surface 112 of the skirt 110 (other than in the position of the first and second release tabs 120*a*, 120*b*).

Figure 1C:
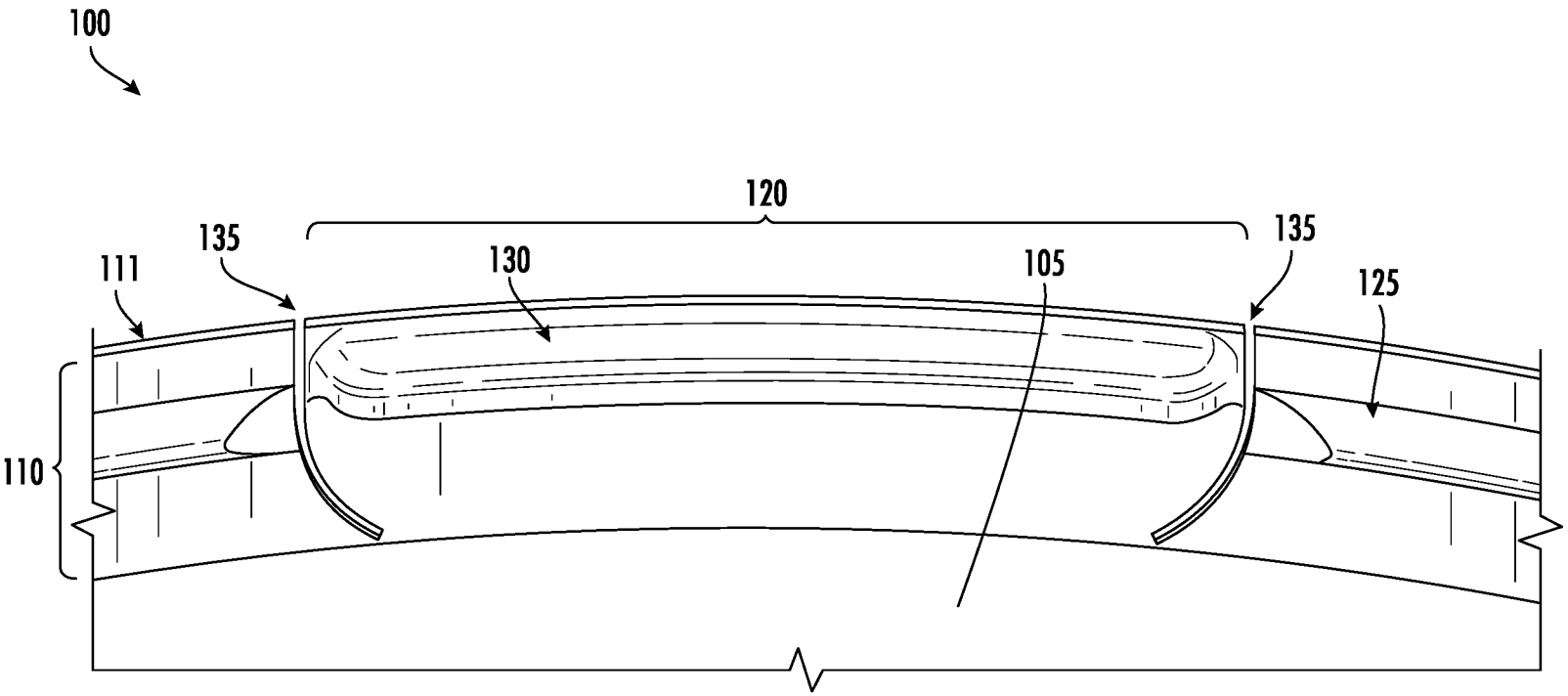
FIG. 1C illustrates a bottom perspective view of the lid in area C-C, shown in FIG. 1B, in accordance with some embodiments of the present disclosure.

FIG. 1C illustrates a portion of the underside of the lid 100 shown in FIG. 1B highlighting the transition between the release tabs 120 and the skirt 110. As described above the release tab 120 may be defined by a cut 135 within the skirt portion, thereby defining the edges of the release tab 120. As illustrated in FIG. 1C, each of the cuts 135 may define a small thickness, such that the skirt portion of the release tab 120 does not directly abut the skirt 110. In some embodiments, the thickness may be up to 1 mm, up to 0.5 mm, or up to 0.25 mm. In some embodiments, the thickness may be large enough such that when the release tab 120 is moved there is no friction between the release tab 120 and the skirt 110, and/or the release tab 120 does not get stuck on the inner surface of the skirt 110.

In some embodiments, the cuts 135 may extend from the bottom edge 111 of the skirt 110 to the base 105 of the lid 100. As illustrated in FIG. 1C, the cut 135 may cease just before intersection with the base 105. In some embodiments, the cuts 135 may be shaped such that the bottom edge 111 of the skirt portion 121 of the release tab is larger than the juncture at or near the circumferential edge 107 of the release tab 120 and the base 105. In some embodiments, the cuts 135 may be curved, diagonal, and/or straight with respect to the skirt 110. In some embodiments, the juncture at or near the circumferential edge 107 may be smaller than the bottom edge 111, while in other embodiments the juncture at or near the circumferential edge 107 may be larger than the bottom edge 111, while in yet still other embodiments the juncture at or near the circumferential edge 107 and the bottom edge 111 of the skirt 110 may be equal.

Figure 4:
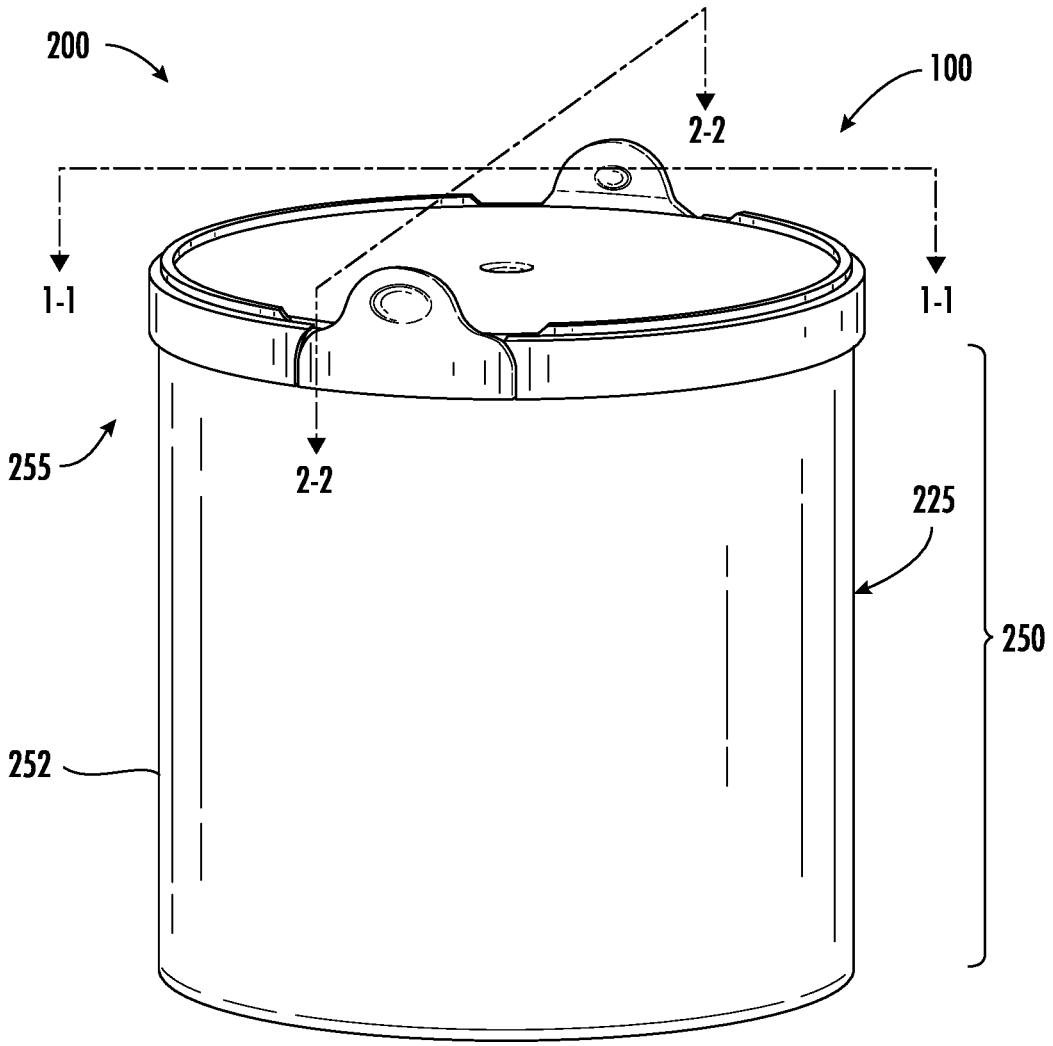
FIG. 4 illustrates a container system in accordance with some embodiments of the present disclosure.

In some embodiments, the cut 135 may extend into the base. In some embodiments, a line of weakness (e.g., 136 of FIG. 4A) may continue partially through an outer surface 113 of the skirt beyond the base. In this regard the plastic material on the outer surface 113 of the skirt may be weakened to encourage flexion of the release tab 120 about the peripheral edge 107.

Each of the release tabs 120 comprise the latching protrusion 130 on the inner surface 112 of the skirt portion 121. The latching protrusion 130 may extend circumferentially between the cuts 135 defining the release tab 120. In some embodiments, the latching protrusion 130 may extend inward, from the inner surface 112 of the skirt portion 121 towards the axial center of the lid 100. In some embodiments, the latching protrusion may abut or be positioned near the bottom edge 111 of the skirt. In some embodiments, the latching protrusion 130 is nearer the bottom edge 111 of the skirt than the skirt protrusion 125.

As noted, the inner surface 112 of the skirt 110, excluding the release tab 120, may define a skirt protrusion 125. In some embodiments, the skirt protrusion 125 may also extend inward, from the inner surface 112 of the skirt 110 towards the axial center of the lid 100. The skirt protrusion 125 may be spaced away from the bottom edge 111 of the skirt 110. Said differently, the skirt protrusion 125 may be positioned closer the base 105 than the latching protrusion 130.

Figure 2A:
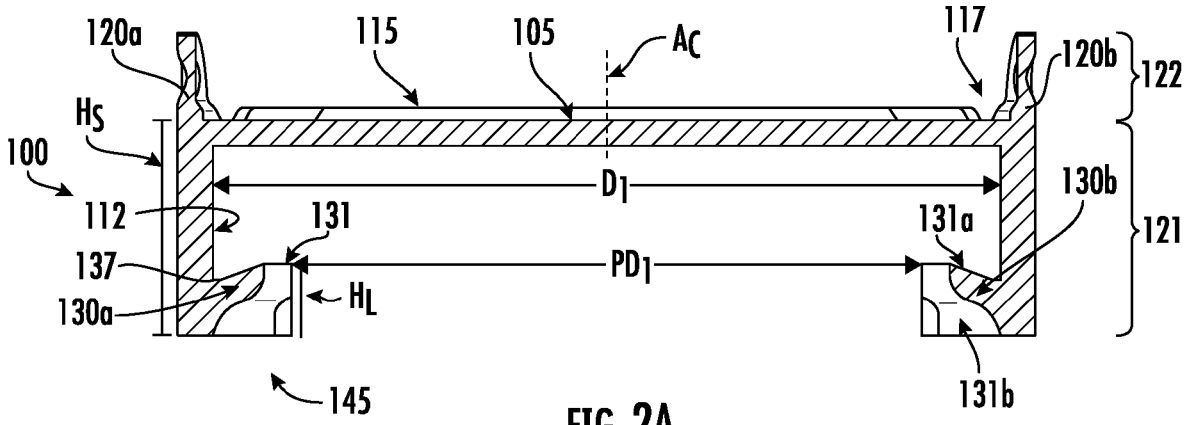
FIG. 2A shows a cross-sectional view of an example lid taken along line A-A in FIG. 1B, in accordance with some embodiments of the present disclosure.
Figure 2B:
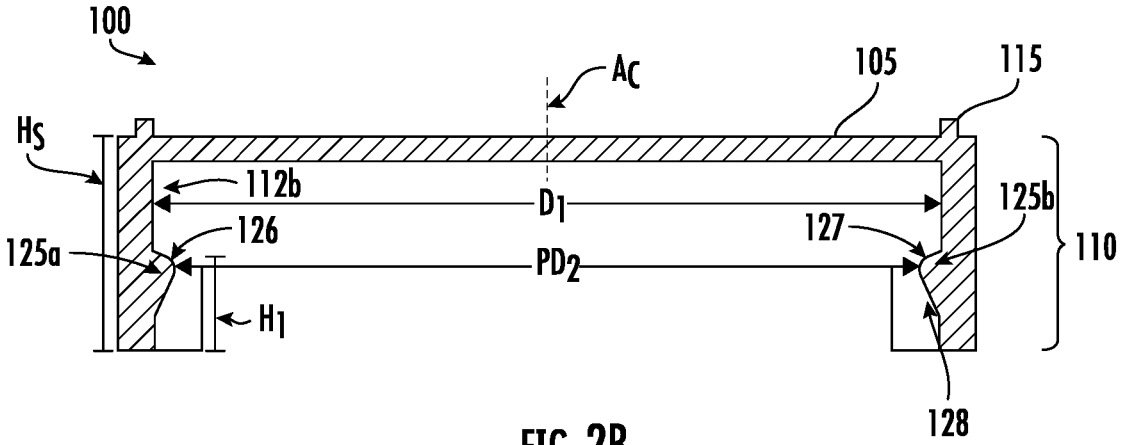
FIG. 2B shows a cross-sectional view of the example lid taken along line B-B in FIG. 1B, in accordance with some embodiments of the present disclosure.

FIGS. 2A-B illustrate cross-sections of the lid 100, to depict the features of the skirt 110. To explain, FIG. 2A illustrates the cross-section of the lid 100 taken across line A-A in FIG. 1B. FIG. 2B illustrates the cross-section of the lid 100 taken across line B-B in FIG. 1B.

FIG. 2A illustrates a cross-sectional view of the lid 100 between the first release tab 120*a* and the second release tab 120*b* illustrating features of the release tabs 120 therein. The upper portion 122 of each release tab 120 extends above the base 105 of the lid 100. In some embodiments, the gap 117 may be adjacent the upper portion 122 thereby separating the upper portion 122 from the circumferential ridge 115, while in other embodiment the upper portion 122 may be directly connected to the circumferential ridge 115. The upper portion 122 may be configured to flex about the base 105 to move the skirt portion 121 away from a container body.

The latching protrusion 130 extending from the skirt portion 121 of each of the release tabs 120 may secure the lid 100 onto a container body. In some embodiments, when the upper portion 122 flexes inwardly, toward the central axis Ac of the base 105, and when the skirt portion 121 flexes outwardly, away from the central axis Ac of the base 105, the latching protrusion 130 may release from the container body to allow the lid to be removed from the container body.

Each latching protrusion 130 may extend radially inward from the inner surface 112 of the skirt 110. In some embodiments, the latching protrusion 130 may extend parallel to the base 105, while in other embodiments, the latching protrusion 130 may extend at an upwards angle towards the base 105. The latching protrusion 130 may be configured to rest under a rim of a container (the rolled rim of a container, for example), such that the lid 100 remains secured onto the container when the latching protrusion 130 is engaged with the container rim. In some embodiments, the latching protrusion 130 may define a first protrusion diameter $PD_1$ extending between a tip 131 of the first latching protrusion 130*a* and the tip 131 the second latching protrusion 130*b*. The first protrusion diameter $PD_1$ may be smaller than a skirt diameter $D_1$ extending between opposite positions about the inner surface 112 of the skirt 110.

The skirt 110 may define a skirt height $H_S$ extending between the base 105 and the bottom edge 111 of the skirt 110. The latching protrusion 130 may extend from the bottom edge 111 of the skirt 110 and extend diagonally upward towards the base 105 of the lid 100. In some embodiments, the tip 131 of the latching protrusion 130 may be at a latching height $H_L$. The latching height $H_L$ may be defined from the bottom edge 111 of the skirt 110 to the tip 131 of the latching protrusion 130.

Figure 5A:
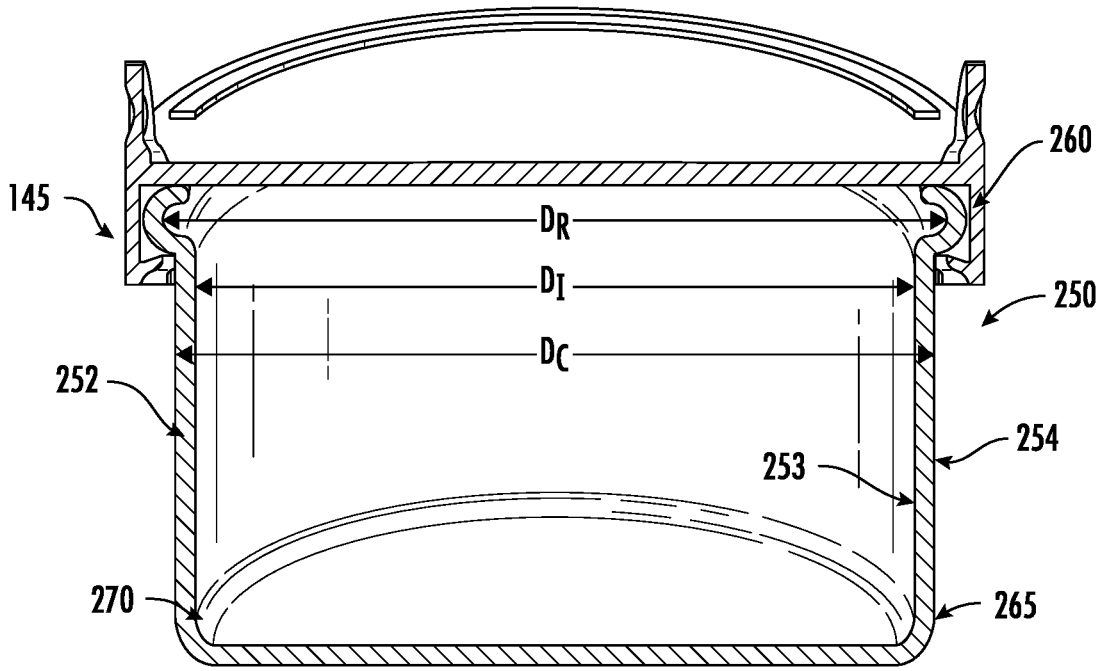
FIG. 5A illustrates a cross-sectional view of the example container system taken across line 1-1 in FIG. 4, in accordance with some embodiments of the present disclosure.

In some embodiments, an upper surface 132 of the latching protrusion 130 may be linear. The upper surface 132 may be configured to retain a rim of a container body (see e.g., FIG. 5A) wherein the tip 131 is positioned between the container body and the rim, while the edge of the rim rests within a corner 137 formed where the upper surface 132 of the latching protrusion 130 and the inner surface 112 of the skirt portion 121 meet.

In some embodiments, a lower surface 133 of the latching protrusion 130 may be contoured. In some embodiments, the lower surface 133 may be configured to guide the latching protrusion 130 over the rim of a container body for easy application of the lid 100 onto the container body. In some embodiments, the lower surface 133 may include concave and convex portions.

Figure 3A:
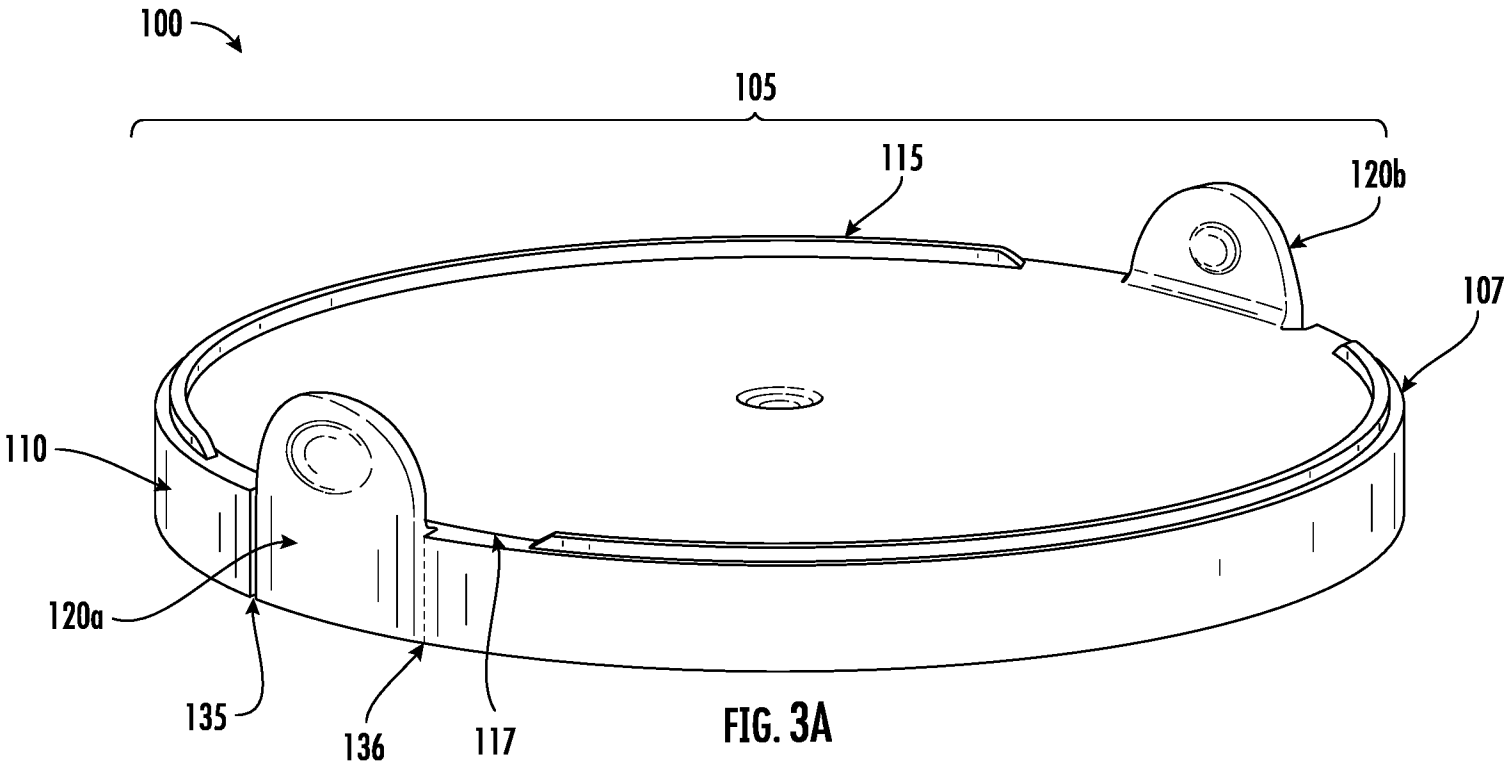
FIG. 3A illustrates a top perspective view of an example lid, in accordance with some embodiments of the present disclosure.
Figure 3B:
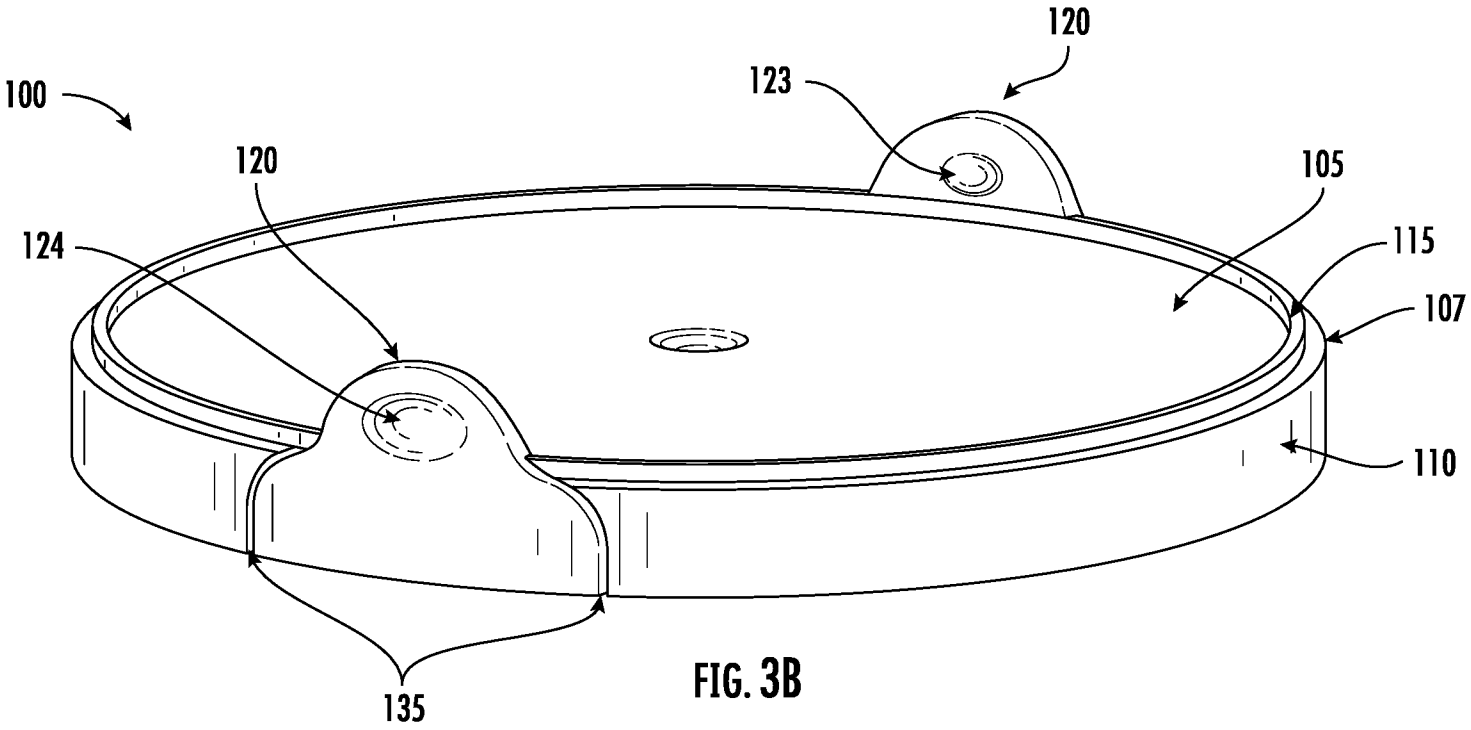
FIG. 3B illustrates top perspective view of an example lid, in accordance with some embodiments of the present disclosure.

FIG. 3B illustrates a cross-sectional view of the lid 100 taken along line B-B between two points which do not include the release tabs 120. In some embodiments, the skirt protrusions 125 may define a second protrusion diameter $PD_2$ extending between a tip 126 of the first skirt protrusion 125*a* and the tip 126 of the second skirt protrusion 125*b*. In some embodiments, the second protrusion diameter $PD_2$ may be larger than the first protrusion diameter $PD_1$, and smaller than the skirt diameter $D_1$.

In some embodiments, the skirt protrusions 125 may define a sealing height $H_1$ extending from the bottom edge 111 of the skirt 110 to the tip 126 of the skirt protrusion 125. The sealing height $H_1$ may be greater than the latching height $H_L$. Said differently, the tip 126 of the skirt protrusion 125 may positioned closer to the base 105 than the tip 131 of the latching protrusion 130.

As explained with reference to FIG. 1C the skirt protrusion 125 is positioned within the skirt 110. To explain, the skirt protrusion 125 does not extend from the bottom edge 111 of the skirt 110, but rather is spaced away from the bottom edge 111 of the skirt 110. In contrast, the latching protrusion 130 may extend from the bottom edge 111 of the skirt 110.

Figure 5B:
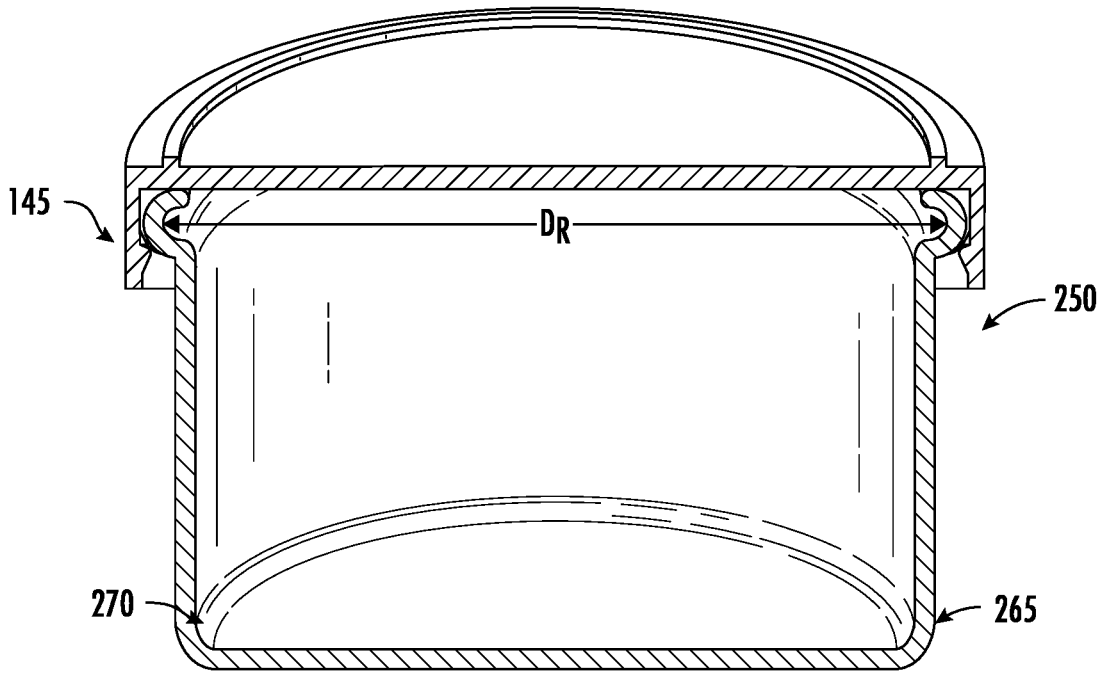
FIG. 5B illustrates a cross-sectional view of the example container system taken across line 2-2 in FIG. 4, in accordance with some embodiments of the present disclosure.

In some embodiments, a lower surface 128 of the skirt protrusion 125 may be linear, and an upper surface 127 of the skirt protrusion 125 may be slightly curved. In some embodiments, the skirt protrusion 125 may be configured to rest about the rim of a container body (see e.g., FIG. 5B), while in contrast, the latching protrusion 130 is configured to engage under the rim of a container body.

FIGS. 3A-B illustrate alternative configurations of the lid 100. FIG. 3A illustrates an alternative configuration of the release tabs 120. In contrast to the contoured release tabs 120 illustrated in FIGS. 1A-C, in some embodiments, the release tabs 120 may define a uniform thickness through the skirt portion 121. In this regard, each of the cuts 135 may be linear and may extend along the height of the skirt 110. The differing shapes of the release tabs 120 may change the length of the latching protrusion 130 and, thus, may change the ease of removing the lid from a container body.

FIG. 3B illustrates the lid 100 wherein the circumferential ridge 115 is continuous about the body 105 of the lid 100. In such embodiments the release tabs 120 may be continuous with the circumferential ridge 115. In some embodiments, the cuts 135 may extend at least partially into the circumferential ridge 115 to provide flexion to the release tabs 120.

Container System

In some embodiments, the present disclosure is directed to a container assembly having a lid, a container, and a bottom closure. In some embodiments, the container and the bottom closure may be paper-based, while in other embodiments, may be plastic based, or metal based, or a combination thereof.

In some embodiments, the bottom closure may be recessed into the bottom end of the container and may form a seal with an interior surface of a cylindrical container body.

The container body and bottom closure may comprise a plurality of layers, including one or more paper-based layers. The one or more paper-based layers of the cylindrical container body and bottom closure may comprise at least about 95% by mass of the container assembly. This percentage of paper content may advantageously qualify the container assemblies as mono material, allowing them to be accepted in the recycling streams of most countries globally.

A container assembly 200 is shown in FIGS. 4-6B. The container system 200 may include a lid 100 and a container 250. The container 250 may have a sidewall 252 defining an upper end 255, wherein the upper end includes a top rim 260 circumscribing a top end of the sidewall 252, and a bottom peripheral edge 265 circumscribing a bottom end of the sidewall 252. The bottom end may comprise a bottom closure 270, optionally recessed into the container body 250. In some embodiments, illustrated in FIGS. 6A-B, the top end may comprise a membrane 280, optionally recessed into the container body.

The top rim 260 may be a rolled rim and may have an outer diameter $D_R$ that is larger than a container diameter $D_C$ corresponding to an exterior surface 254 of the container sidewall 252. Alternatively, the top rim 260 may comprise a metal (or other material) end having bead, wherein the end is seamed onto the container. For example, the metal end may have a peelable aluminum membrane, easy-open ("EZO") function, or ring-pull, and the bead may also have an outer diameter that is larger than the outer diameter of the container sidewall 252.

In some embodiments, the container body 250 may comprise a rigid cylinder. In such cylindrical embodiments, the container body 250 may have an inner diameter $D_1$ of about 3-16 cm (about 1-8 in.). For example, the container body 250 may have an inner diameter $D_1$ of about 7.315 cm (about 2.880 in.). In some cylindrical embodiments, the inner diameter $D_1$ of the container body 250 may be within a range of about 3-20 cm (about 1-8 in.). For example, the container body 250 may have an inner diameter $D_1$ of about 7.630 cm (about 3.004 in.). The bottom closure 270 of the container 250 may be circumscribed by a bottom peripheral edge 265 formed by the terminating edge of the sidewall 252 that forms the body of the container body 250. The sidewall 252 may include an interior surface 253 facing the container interior and an exterior surface 254 facing the outside of the container body 250. The interior surface 253 may be the product-facing side of the sidewall 252 of the container body 250. In some embodiments, the product(s) may be food products, and the interior surface 253 may include a food safe layer, lacquer, film, liner, and/or coating to help protect the integrity of the food product(s) to be contained within the container body 250. The exterior surface 254 may include printing or other applied graphics for labeling and/or advertising the product(s) to be contained within the container body 250. In an embodiment, the outer surface of the lid 100 may be coated with polyethylene or any lacquer known in the art.

In some embodiments, the sidewall 252 of the container body 250 may have a thickness (e.g., as measured from the interior surface 253 to the exterior surface 254 of the container sidewall 252) of about 0.05-0.2 cm (about 0.02-0.787 in.). For example, the sidewall 252 of the container body 250 may have a thickness of about 0.157 cm (0.062 in.).

As discussed, with reference the lid 100, first protrusion diameter $PD_1$ may smaller than the outer diameter of the rim, also referred to as the rim diameter $D_R$ of the container 200. Thus, before application of the lid 100 onto the container 200 the latching protrusions 130 may rest on the rim 260 of the container 200. In some embodiments, to overcome the difference in diameters the lid 100 may be applied onto the container 200 using an application of force. A minimal force allows the release tabs 120 to flex about the base 105. While in other embodiments the release tabs 120 may be pivotably towards one another to expand the first protrusion diameter $PD_1$ to allow the latching protrusions 130 to expand over the apex of the rim 260. In some embodiments, the container system 200 may include a sealing compound 282 about the top rim 260, illustrated in FIGS. 6A-B.

In some embodiments, the tip 131 of the latching protrusion is secured at a transition point, where the rim 260 transitions into the container body 250. Thus, the first protrusion diameter $PD_1$ of the lid 100, is approximately equivalent to the container diameter $D_C$, wherein the container diameter $D_C$ extends between exterior surfaces 252 of the container body 250. The diagonal shape of the latching protrusion 130 may prevent the lid 100 from being improperly removed from the container body 250, as pulling the lid 100 with an upward force, without engaging the release tabs 120, would not cause the release tabs 120 to flex to allow the tip 131 of the latch protrusion 130 to flex detach from the container body 250.

In some embodiments, the second protrusion diameter $PD_2$ may be slightly smaller than the rim diameter $D_R$ and may be slightly larger than the container diameter $D_C$. Thus, the skirt protrusion 125 may rest just under the apex of the rim 260, wherein the apex is the widest point of the rim 260 thereby forming an interference fit. In some embodiments, since the skirt protrusion 125 is smaller than the latching protrusion 130 the skirt protrusion 125 may slide over the rim 260 of the container body 250 without needing to release from the rim 260.

While the container may be cylindrical, is should not be so limited. In some embodiments, the container may have a square, hexagonal, pentagonal, rectangular, triangular, or irregular cross-section. The lid 100 may have a shape and configuration which correlates to the cross-section of the container 250. Thus, for a cylindrical container, the lid 100 may be disc shaped. However, a container with a square cross section may be fitted with a square lid, for example.

Figure 7:
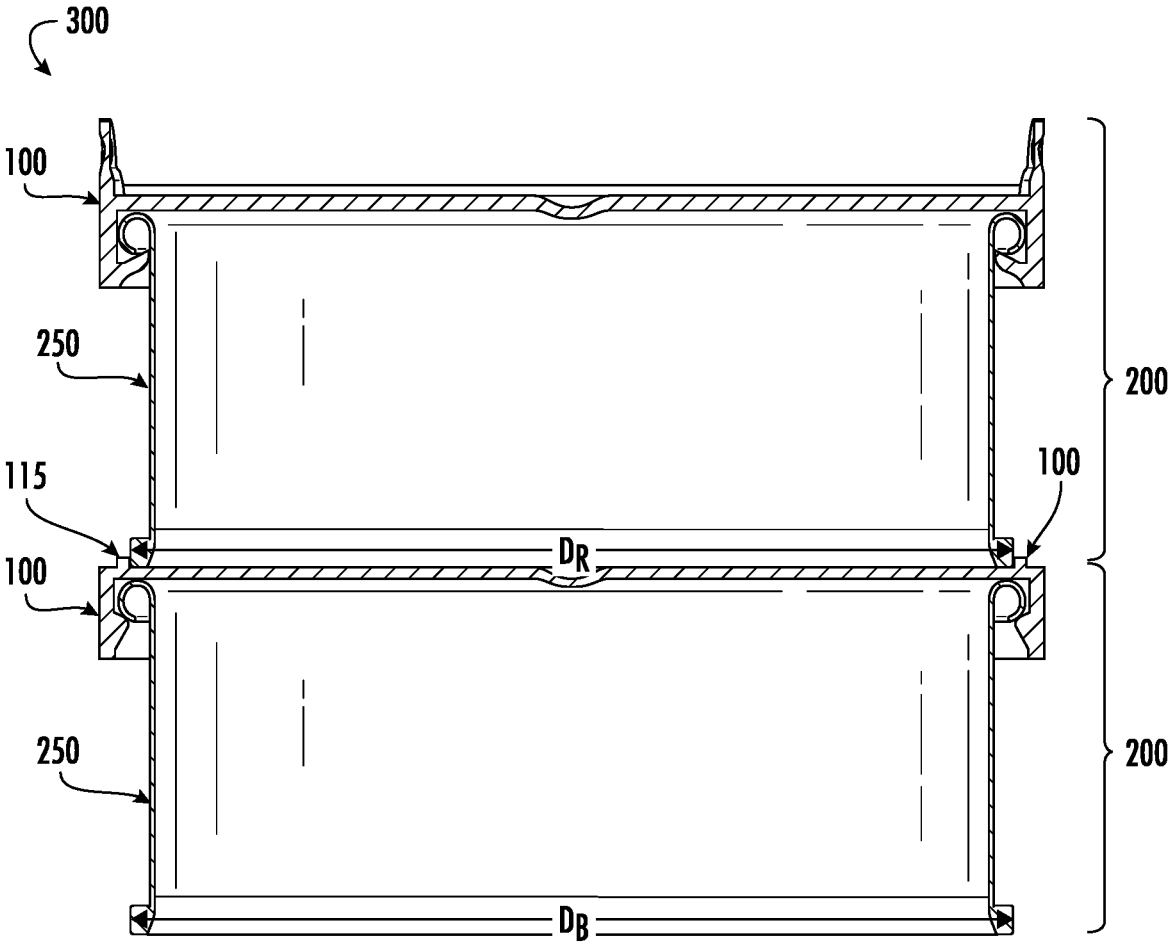
FIG. 7 illustrates a cross-sectional view of two container systems stacked, in accordance with some embodiments of the present invention.

In some embodiments, the container system 200 is configured to be stackable, as illustrated in FIG. 7. Thus, the circumferential ridge 115 of the lid may define a ridge diameter $D_R$. In some embodiments, the ridge diameter may be substantially equivalent to the container diameter $D_C$. Thus, the container body 250 may rest securely within the circumferential ridge 115.

In some embodiments, the container body 250 may be designed such that the bottom peripheral edge comprises a bottom diameter $D_B$, wherein the bottom diameter $D_B$ is larger than the container diameter $D_C$. In such embodiments the ridge diameter $D_R$ may be larger than the container diameter $D_C$, and the ridge diameter $D_R$ may be substantially equivalent to the bottom diameter $D_B$. In both configurations the container body 250 is designed to rest snuggly within the circumferential ridge 115 of the lid 100 to provide for easier and more secure stacking of like container systems 200.

In some embodiments, the rigid sidewall 252 of the container body 250 may include multiple layers, such as a paper-based layer, a barrier layer, an ionomer layer, and/or a tie layer, for example. Each component layer (paper-based layer, a barrier layer, ionomer layer) may comprise a single layer or may comprise a plurality of layers.

In an embodiment, the lid 100 is strong enough to withstand transportation of the container on its lid 100, from the production line to the customer. Likewise, the lid 100 is strong enough to withstand the filling and finishing of the container by the customer, transportation to retail stores, and ultimately transportation to the home of the consumer and use/reuse by the consumer. In an embodiment, the lid 100 is able to withstand temperature and humidity changes that may occur during transportation. In an embodiment, the lid 100 protects the goods contained within the container, is optically/aesthetically acceptable, is recyclable (preferably in the same stream as the container body), and meets other customer requirements.

In some embodiments, the lid 100 may be used in connection with a membrane seal. In this embodiment, the membrane seal may be sealed onto the container rim prior to application of the lid 100 thereto. In other embodiments, the lid 100 itself may be sealed onto a container rim and may, therefore, avoid the need for a membrane seal. That is, the lid 100 may form a hermetic seal with the rim of the container in an embodiment.

What is claimed is:

1. A lid comprising:

a base comprising a peripheral edge;

a skirt extending downward from the peripheral edge, wherein the skirt comprises:

a pair of release tabs diametrically opposite from one another; and at least one skirt protrusion extending:

circumferentially parallel to the peripheral edge, radially inward from an inner surface of the skirt towards the center of the lid, at least partially about the circumference of the inner surface of the skirt, and in a location other than in the circumferential location of the release tabs; and wherein:

the skirt protrusion defines a second protrusion diameter:

each of the pair of release tabs are defined by a first cut and a second cut within the skirt which separates the release tab from the remainder of the skirt, each of the pair of release tabs is hingedly connected to the base, and each of the pair of release tabs extends upwardly from the base, opposite the skirt, each release tab comprising a latching protrusion extending radially inward from an inner surface of the release tab, toward a central axis of the lid, wherein the latching protrusions define a first protrusion diameter, and wherein the first protrusion diameter is smaller than the second protrusion diameter.

2. The lid of claim 1, further comprising:

a circumferential ridge extending from a top side of the base spaced radially inward from the peripheral edge of the base.

3. The lid of claim 2, wherein the circumferential ridge is adjacent to the pair of release tabs.

4. The lid of claim 2, wherein the circumferential ridge is spaced apart from the pair of release tabs.

5. The lid of claim 1, wherein the skirt protrusion comprises a tip positioned at a first height and the latching protrusion comprises a tip positioned at a second height, wherein the first height and the second height are different.

6. The lid of claim 5, wherein the tip of the skirt protrusion is positioned closer to the base than the tip of the latching protrusion.

7. A lid comprising:

a base comprising a peripheral edge;

a skirt extending downward from the peripheral edge, wherein the skirt defines a skirt protrusion extending:

circumferentially parallel to the peripheral edge, radially inward from an inner surface of the skirt towards the center of the lid, at least partially about the circumference of the inner surface of the skirt, and in a location other than in the circumferential location of the release tabs;

and wherein the skirt protrusion defines a second protrusion diameter;

a first release tab disposed within the skirt, defined by a first cut and a second cut within the skirt, wherein the first release tab extends upwardly from the base, opposite the skirt, wherein the first release tab is hingedly connected to the base, the first release tab comprising:

a first latching protrusion extending radially inward from an inner surface of the first release tab, towards a central axis of the lid; and a second release tab disposed within the skirt, defined by a third cut and a fourth cut within the skirt, wherein the second release tab extends upwardly from the base, opposite the skirt, wherein the second release tab is hingedly connected to the base, and wherein the second release tab is diametrically opposed from the first release tab, the second release tab comprising:

a second latching protrusion extending radially inward from the inner surface of the second release tab, towards the central axis of the lid, wherein a first protrusion diameter extends between the first latching protrusion and the second latching protrusion, wherein the first protrusion diameter is smaller than the second protrusion diameter.

8. The lid of claim 7, further comprising:

a circumferential ridge extending from a top side of the base spaced radially inward from the peripheral edge of the base.

9. The lid of claim 8, wherein the circumferential ridge is adjacent to the first release tab and the second release tab.

10. The lid of claim 9, wherein the circumferential ridge extends between the first cut and the third cut, and between the second cut and the fourth cut.

11. The lid of claim 7, wherein the skirt protrusion comprises a first skirt protrusion extending between the first cut and the third cut.

12. The lid of claim 11, wherein the skirt protrusion comprises a second skirt protrusion extending between the second cut and the fourth cut.

13. The lid of claim 12, wherein the first skirt protrusion is symmetrical to the second skirt protrusion about the central axis of the lid.

14. The lid of claim 12, wherein the first skirt protrusion and the second skirt protrusion comprise a tip positioned at a first height, and the first latching protrusion and the second latching protrusion define a tip positioned at a second height, wherein the first height and the second height are different.

15. The lid of claim 14, wherein the tip of the first skirt protrusion and second skirt protrusion is closer to the base than the tip of the first latching protrusion and second latching protrusion.

16. The lid of claim 7, wherein the each of the first cut, the second cut, the third cut, and the fourth cut, do not intersect the base.

17. A container system comprising:

a lid, wherein the lid comprises:

a base comprising a peripheral edge;

a skirt extending downward from the peripheral edge; and a pair of release tabs diametrically opposite from one another, disposed within the skirt, wherein each of the release tabs are defined by a first cut and a second cut within the skirt, wherein each of the pair of release tabs extends upwardly from the base, opposite the skirt, each release tab comprising:

a latching protrusion extending radially inward from an inner surface of the release tab, toward a central axis of the lid, wherein the latching protrusions define a first protrusion diameter, wherein the skirt comprises a skirt protrusion extending:

circumferentially parallel to the peripheral edge, radially inward from an inner surface of the skirt towards the center of the lid, at least partially about the circumference of the inner surface of the skirt, and in a location other than in the circumferential location of the release tabs; and wherein the skirt protrusion defines a second protrusion diameter; and a container, wherein the container comprises:

a container body comprising:

a bottom; and a side wall defining a rim circumscribing a top opening of the container body, wherein a rim diameter is larger than the first protrusion diameter, wherein when the lid engages the container body, the latching protrusions of the pair of release tabs are positioned such that the rim of the container is adjacent the skirt, and the rim is retained between the latching protrusions and the base of the lid.

18. The system of claim 17, wherein the lid is configured to be removed from the container body by pressing the pair of release tabs towards the central axis of the lid and moving the lid along the central axis away from the container body.

19. The lid of claim 1, wherein the latching protrusion defines an upper surface, wherein the upper surface extends from a corner formed with the inner surface of the skirt to a tip, such that the upper surface of the latching protrusion extends at an upward angle towards the base such that the tip is closer to the base than the corner.

20. The lid of claim 1, wherein the latching protrusion defines a lower surface, wherein the lower surface of the latching protrusion is contoured.

21. The system of claim 17, wherein the skirt protrusion is configured to abut the rim of the container body.

22. The system of claim 17, further comprising a sealing compound positioned between the base and the rim.

* * * * *